United States Patent [19]

Fries

[11] 3,946,238

[45] Mar. 23, 1976

[54] SHIELDED RADIOISOTOPE GENERATOR AND METHOD FOR USING SAME

[75] Inventor: Bernard A. Fries, Orinda, Calif.

[73] Assignee: Chevron Research Company, San Francisco, Calif.

[22] Filed: Aug. 5, 1974

[21] Appl. No.: 495,007

[52] U.S. Cl. ..... 250/432 PD

[51] Int. Cl.[2] ..... G21G 4/08

[58] Field of Search ..... 250/308, 428, 430, 432, 250/434, 435, 493, 496, 497, 506, 507, 515, 432 PD; 252/301.1 R, 301.15; 23/252 R; 128/1.1, 1.2

[56] References Cited

UNITED STATES PATENTS

| | | | |
|---|---|---|---|
| 3,576,998 | 5/1971 | Deutsch et al. | 250/432 |
| 3,774,035 | 11/1973 | Litt | 250/430 |

*Primary Examiner*—Davis L. Willis

*Attorney, Agent, or Firm*—R. L. Freeland, Jr.; H. D. Messner

[57] ABSTRACT

A nuclide generator for on-site radioisotope generation is disclosed in which the formation of a short-lived daughter radioisotope from its longer-lived parent features batch flow of eluting reagent interior of the generator in a completely shielded environment.

11 Claims, 5 Drawing Figures

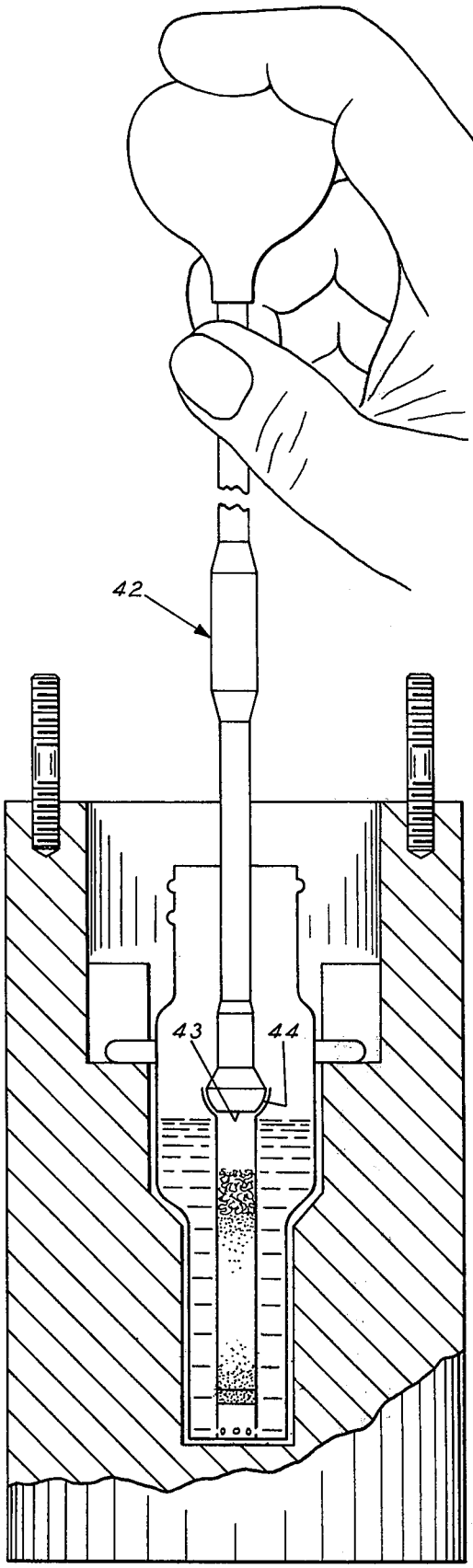
FIG. 3
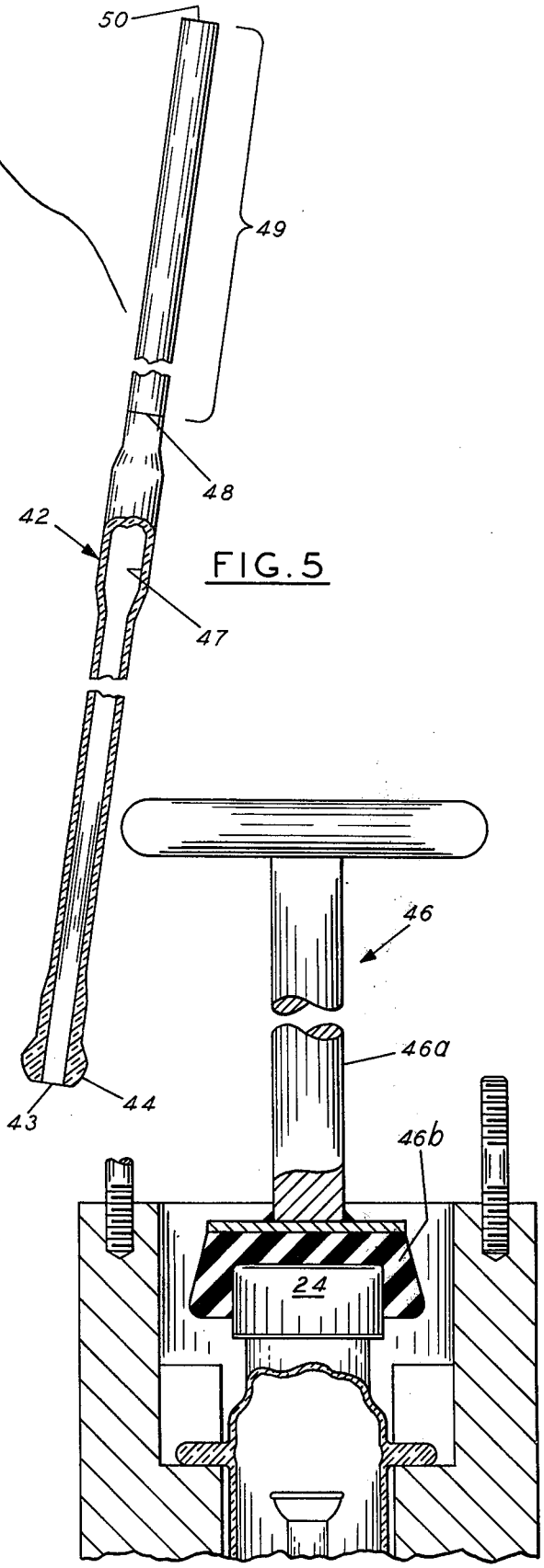
FIG. 5
FIG. 4

SHIELDED RADIOISOTOPE GENERATOR AND METHOD FOR USING SAME

RELATED APPLICATION

Application Serial No. 495,006, Bernard A. Fries, for "Support Housing for Radioisotope Generation," filed simultaneously herewith, is incorporated herein by reference.

BACKGROUND OF THE INVENTION

The invention relates to a shielded radioisotope generator for use in various on-site industrial and medical applications, and has as an object the provision of a novel shielded radionuclide generator in which the formation of a short-lived daughter radioisotope from its longer-lived parent features batch flow of the eluting reagent of the separation system in a completely shielded environment.

DESCRIPTION OF THE PRIOR ART

To perform diagnostic tests in industrial and medical radioapplications, short-lived nuclides are particularly attractive. However, the short-lived radioisotopes lose much of their radioactivity during their transportation from the manufacturer to the application sites. To use them effectively, it is necessary to be near a source of production of short-lived nuclides, or to use what is called a "nuclide generator." Such a device makes short-lived nuclides available at long distances from the source of production, and consists of a longer-lived parent nuclide that produces a short-lived daughter nuclide as it decays. Usually the daughter nuclide is separated by chemical means as it is needed and the parent is left to generate a fresh daughter.

A nuclide generator is based on the principle that a daughter nuclide can be separated readily and repeatedly from its longer-lived parent nuclide. Differences in chemical behavior are used to achieve the separation. The general relationship between parent and daughter radioactivity can be derived from the interaction of the decay constants of the two radionuclides. After the daughter nuclide has been removed from the parent, the daughter activity increases progressively as the parent decays, until they reach a state of transient equilibrium, at which point the ratio of the two activities remains constant and both appear to decay with the half-life of the parent.

A typical commercially available generator of technetium-99 ($^{99}$mTc) consists of a small galss column containing aluminum oxide on which the parent isotope activity molybdenum-99 ($^{99}$Mo) is firmly absorbed. The alumina is retained in the tube by a porous glass disk. The daughter activity is eluted by gravity from the generator by pouring the proper reagents on the top of the column and collecting the eluate from the bottom.

In another typical nuclide generator, an artificial barrier (filter) is placed across a tubular column to form separate chambers. The open end of the column is then sealed with a puncturable stopper. A suspension of non-replenishable ("one-shot") radioactive parent nuclide material is disposed in one of the two chambers of the column, resulting in a transient equilibrium state between the parent and daughter isotopes. Thereafter, the daughter nuclide solution can be withdrawn—under pressure—by operation of a syringe positioned at the remote end of the second chamber. However, remote serviceability, as by a human operator, say from a position totally outside a shield surroundng the operator, is not possible.

SUMMARY OF THE INVENTION

In accordance with the present invention, a novel shielded radioisotope generator consists of two elements:

i. a cylindrical housing shield, formed typically of lead, surrounding ii. a nuclide generator having parent and daughter isotopes in transient equilibrium.

Constructional features are provided which allow—in safety—an operator (who may be unskilled in the detection of radiation overdoses) to conduct successive parent-daughter nuclide separations in complete safety, say where his body extremities remain at positions remote to the shield (and generator). In this regard, the shield and generator are provided with ultra-wide entryways at their upper adjacent ends. Result: injection of the eluting reagent as well as subsequent removal of the daughter nuclide solution are facilitated.

Further features, advantages and objects of the invention become more apparent in the following detailed description of a preferred embodiment when taken in consideration with the accompanying drawings.

DESCRIPTION OF THE DRAWINGS

FIG. 1 is a side elevation, partially in section, of a shielded nuclide generator of the present invention;

FIGS. 2 and 3 are schematic side elevations of the shielded nuclide generator of FIG. 1, illustrating its employment at a field site;

FIG. 4 is a side elevation of a transfer tool useful in readying the nuclide generator of FIG. 1 at its field site, wherein the present invention may be particularly useful; and FIG. 5 is a side elevation of a transfer pipette for providing the eluting reagent to, as well as removal of the daughter nuclide from, the shielded nuclide generator of FIG. 1.

DETAILED DESCRIPTION OF A PREFERRED EMBODIMENT

Figures 1, 2:
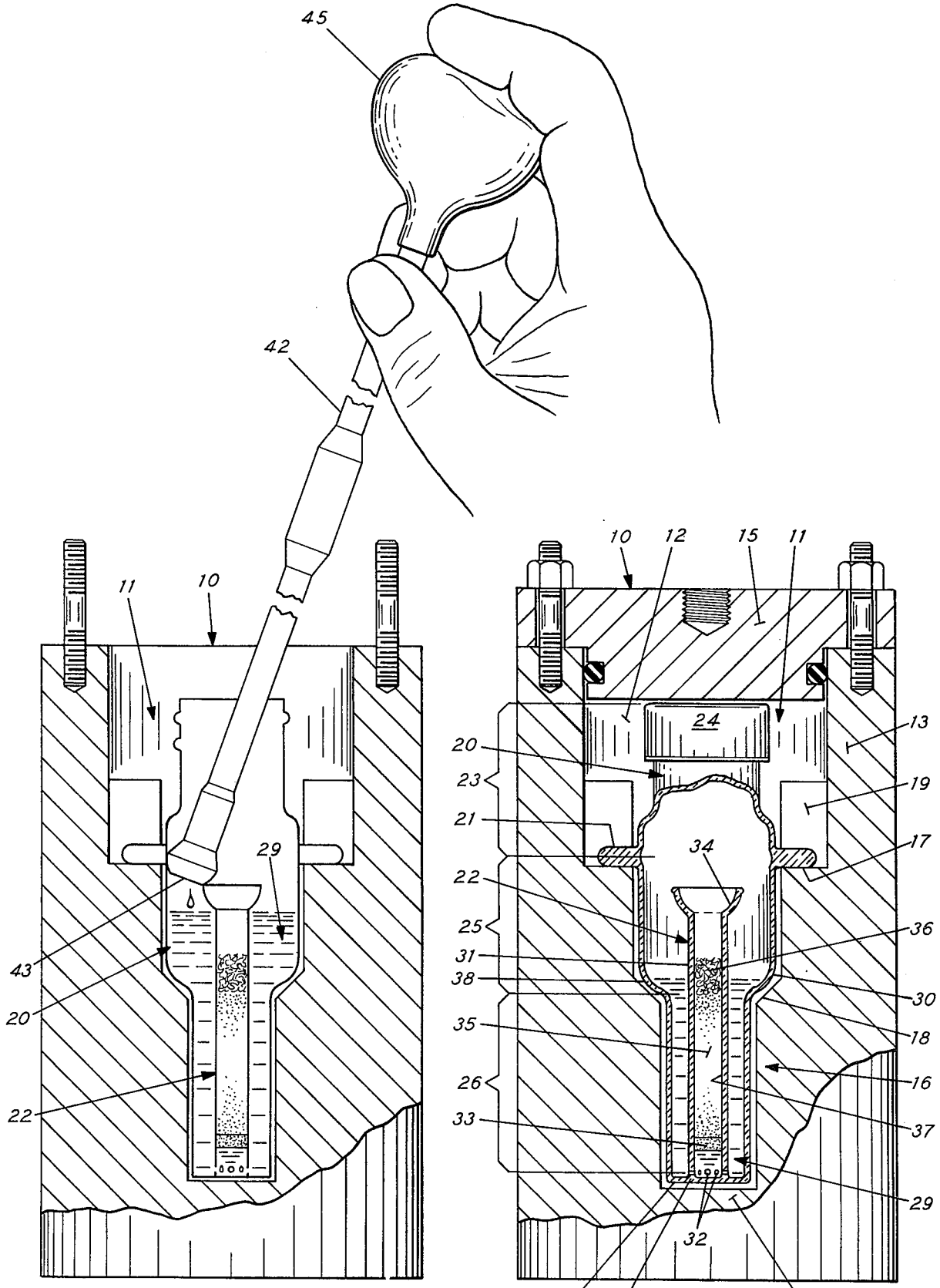

Reference should now be had to the drawings, particularly FIG. 1, in which shielded housing 10 is shown surrounding a nuclide generator 11.

Cylindrical shielded housing 10 includes a central repository 12. The repository 12 is bounded by side wall 13, bottom wall 14 and a top cover 15. Top cover 15 is dimensioned so as to fit into contact with side wall 13 of the housing, say by threads as shown.

Other fastening means, of course, are permissible either alone or in combination with the threaded joint of FIG. 1. That is, a circumferential seal can be provided at the intersection of the top cover 15 with the side wall 13 using techniques developed in sealing cans in the food processing art. Such seals are particurly useful in those situations where leakage of radioactive materials cannot be tolerated for various reasons, as where public transportation is utilized to ship the shielded generator of the present invention to the remote field site.

Side wall 13, typically formed of lead material, does not feature a constant thickness throughout its length.

E.g., at adjacent cover 15 it is of a minimum thickness, while at lower segment 16 it is of a maximum thickness. Between these extremities it is stepped, say, at step 17 and at step 18, between which concavities 19 are formed. Purpose: to add stability of nuclide generator 11 when positioned within shielded housing 10, as explained below.

Nuclide generator 11 includes a bulbous bottle 20; the bottle 20 has diametrically opposed lugs 21; the lugs 21 fit snugly within the concavities 19 of housing 10. Above the top 21 is threaded upper end 23. Attached to the end 23 is a cap 24. Adjacent the lugs 21 there is also provided an enlarged midportion 25, while below the lugs 21 is a reduced lower segment 26; the latter has a bottom wall 27 to which remote end 28 of the column 22 is attached so as to be concentrically positioned interior of the bottle 20.

Annular space 29 is defined between coextensive and adjacent side surfaces of the housing, say between adjacent surfaces of side wall 30 of the bottle 20 and side wall 31 of the central column 22. The annular space 29 is seen to be of constant nominal diameter over lower segment 26, since the axis of symmetry of the bottle and column are co-linear in this region; but as the bottle is also seen to be enlarged over its midsection 25, the space 29 is likewise enlarged in stepped region 38.

In order to allow fluid communication between the inner and outer surfaces of the column 22, a series of radial openings 32 are provided in side wall 31, as shown in FIG. 1. Above the openings 32 is frit 33. Spaced still higher along the column, but below cap 24, is female ball-joint member 34.

ON-SITE OPERATIONAL ASPECTS OF THE INVENTION

Operational aspects of the present invention for on-site radioisotope generation are best illustrated with reference to FIGS. 1, 2 and 3.

In FIG. 1, an ion-exchange bed 35 onto which a long-lived parent isotope is absorbed is seen to be positioned between frit 33 and glass wool 36. Note that the upper end 37 of the bed 35 is below step 38 of the side wall 30 of the bottle 20, step 38 of the bottle separating midportion 25 and reduced segment 26 in the manner previously described.

Ion-exchange bed 35 comprises, typically, treated stainless-steel powder over which a suitable surface layer has been laid, typically iron hexacyanoferrate. A parent isotope, for example 137Cs, is likewise present. The upper one-third of bed 35 can be provided with a wad of parent-free isotope particles. Purpose: to restrict contamination during separation of the parent and daughter nuclides.

While a suitable surface-layer/parent-nuclide combination can include iron hexacyanoferrate on stainless-steel particles onto which 137Cs has been absorbed, other combinations are also possible. In this regard, see *Radiochimica Acta* 11, No. 3/4, pp. 153–158 (1969).

In FIG. 1, note that annular space 29 is seen to be filled with a suitable eluting reagent, for example dilute hydrogen chloride; its ultimate level is slightly above the end 37 of the bed 35. Of course, during initialization of the process, say at a central laboratory, the eluting reagent flows from annular space 29 through openings 32 (FIG. 1) into contact with bed 35 in a countercurrent flow pattern. At the field site, however, the daughter nuclide, for example 137mBa and its parent, 137Cs, are usually already in a transient equilibrium state.

FIGS. 2 and 3 illustrate on-site operation of the present invention.

In FIG. 2, with cover 15 and lid 24 removed, a transfer pipette 42 is seen to be positioned with its near end 43 above annular space 29 of the nuclide generator. Assume that the pipette 42 has been filled with an incremental amount (batch) of eluting reagent (say 5 ml of dilute hydrogen chloride) and that the pressure has been briefly applied by syringe 45 and then released. Result: transfer of the reagent into the column 22 via the annular space 29, openings 32 and thence interior of the column 22 occurs. Such transference is termed "batch flow," even though the change in height of the reagent relative to the space 29 as well as interior of the column 22 is almost immediately equalized. Since transient equilibrium of the parent-daughter nuclide in the upper region of the column 22 is already achieved, as previously mentioned, removal of the daughter nuclide can be almost immediately undertaken.

FIG. 3 illustrates how the daughter nuclide is removed from the upper region of column 22.

In FIG. 3, the near end 43 of the transfer pipette 42 has been sidetracked from its position shown in FIG. 2 to a new location which places it into contact with female member 34. With regard to the pipette 42 in the above position, note that the end 43 is provided with a curved lip 44. The outwardly curved orientation of the lip 44 is opposite to that of the female ball-joint member 34 to form a conventional glass spherical joint when united (FIG. 3).

Placing lip 44 in contact with the member 34, followed by application of suction, as at the remote end, allows the immediate withdrawal of the daughter nuclide from the upper extremity of column 22. The volume amount removed is usually equal to the amount of batch reagent added to the nuclide generator, viz., 5 ml. Thereafter, the cap 24 (FIG. 1) can be attached to the bottle 20; such operations are facilitated by transfer tool 46 (FIG. 4) having a long handle segment **46*a*, which allows the operator's hands to always remain outside the shielded area of the nuclide generator. Capture plug 46*b* of the transfer tool 46 is preferably formed of rubber and can be properly dimensioned to insert and grasp the cap 24** at its interior to allow its rotation relative to the bottle.

Note that FIGS. 2 and 3 clearly show that the transfer pipette 42 is long enough so that during nuclide generation at a remote site the operator's hands remain exterior of the shield housing 10, i.e., his hands remain well outside the upper lateral extent of the housing 10 during all process steps. In this regard, after the suction means 45 has been attached to the pipette 42 using long tubing, the pipette 42, itself, can be grasped by long-handled tongs wielded by the human operator to increase his separation from the nuclide generator interior the housing, further reducing radiation hazards to a minimum.

FIG. 5 illustrates further features of the transfer pipette 42.

As shown, the pipette 42 is cylindrical and includes an enlarged cavity 47; above the cavity 47 is a circumferential mark 48 indicating the desired level that "batch" fluids interior of the pipette 42 are to achieve; i.e., the amount of "batch" fluid that is to be added or removed from the generator at the field site. Upper segment 49 is formed between cavity 47 and remote end 50.

A shielded radionuclide generator of the present invention constructed with the following dimensions has been successfully operated:

Shielded Housing 10
- Material: Lead
- Side wall 13
- OD = 3-1/2"
- Height = 5-3/8"
- Bottom Wall 14
- Thickness = 3/4"
- Top Cover 15
- Min. thickness = 1/2"
- Max. thickness = 15/16"
- Central Repository 12
- Height (with cover 15 in place) = 4-1/4"
- Max. diameter = 2-1/8"
- Min. diameter = 5/8"

Nuclide Generator 11
- Material: Glass
- Bulbous bottle 20
- Threaded upper end 23 = 3/16" OD × 1" high
- Midportion 25 = 1/16" OD × 1-1/4" high
- Lower segment 26 = 5/8" OD × 1-3/4" high
- Side wall 30 = 1/16" thick
- Column 22 - 1/4" OD × 2-1/2" high
- Female ball-joint member 34 = 5/8" radius × 1/4" high (\$12/5-outer)
- Side wall 31 = 1/32" thick Exchange Bed 35
- Height = 1-5/16"
- Diameter = 2-1/4"
- Composition = Layered iron hexacyanoferrate on stainless-steel particles
- Parent isotope = $^{137}$Cs
- Daughter isotope = $^{137m}$Ba
- Eluting reagent = 0.01 or 0.001N HCl
- Guard bed = $^{137}$Cs-free Transfer Pipette 42
- Material: Glass
- Length = 14-5/8"
- Upper segment 49
- Length = 6-3/4"
- Diameter = 1/4"
- Male ball-joint member 43 = \$12/5-inner
- Cavity 47
- Length = 2-1/2"
- Diameter = 3/8"
- Transfer tool 46
- Handle 46a
- Length = 18"
- Capture plug 46b
- Material: Rubber Stopper, No. 10 size
- Diameter = 2"

EXAMPLE

An exchange bed 35 was formed of 2 grams of stainless-steel particles loaded with 16 mCi $^{137}$Cs above a guard bed of about 1 gram of $^{137}$Cs-free particles. An eluting reagent of 5 ml dilute hydrogen chloride solution (0.01N) was passed interior of the generator in a countercurrent flow pattern. Transient equilibrium between the parent and daughter nuclide was achieved after a short time; maximum 15 minutes, with 50% growth of daughter in 2.5 minutes. Thereafter, the daughter nuclide, $^{137}$mBa was removed by adding an additional 5 ml of the dilute HCl solution to the generator, and thereafter removing a similar amount from a region above the exchange bed 35. Amount of $^{137}$mBa provided: about 10 mCi. The decontamination factor was $10^5$ with respect to eluted $^{137}$Cs. Repetition rate for daughter removal: 15 minutes. Specific activity of the $^{137}$mBa was about 2 mCi/ml.

While a specific embodiment of this invention has been described, it should be understood that the invention is capable of other specific embodiments and modifications, and is fully defined in the following claims.

What is claimed is:

1. A shielded radionuclide generator for on-site radioactive parent-to-daughter isotope generation in which said parent radioisotope absorbed on an ion-exchange bed is selectively contacted with an eluting reagent to generate said short-lived daughter isotope comprising:

i. shield means formed of a radiation-resistive material and including an entryway and a central repository defined by said entryway, including a side wall and a bottom wall, ii. a nuclide generator positioned within said repository of said shield means for generating said short-lived daughter isotope, iii. said nuclide generator including bottle means having a mouth and a central cavity defined by a side wall and a bottom wall, iv. a cylindrical column means positioned within said cavity of said bottle means by attachment to said bottom wall of said bottle means and including means attached to its interior suitable for support for said ion-exchange bed, v. said column means also including a series of openings through its side wall adjacent to said bottom wall of said bottle means whereby said eluting reagent, at least during initialization of the process, is conveyed from locations exterior of said column means through said openings and thence into the interior of said column means in a batch flow pattern.

2. The shielded generator of claim 1 in which said shield means is formed of lead and said bottle and column means are formed of glass.

3. The shielded generator of claim 1 in which said shield means and said bottle means are provided with detachable cover means to facilitate easy and safe transport of said nuclide generator from a central location to a more remote on-site location where generation of said daughter isotope can occur.

4. The shielded generator of claim 3 in which said column means of said nuclide generator includes a second end spaced above said exchange bed but below said mouth of said bottle means, said second end being formed with an outwardly curved lip capable of forming a pressure joint through surface contact with an exterior pipette transfer means capable of being brought into contact therewith by an operator whose hands remain remote to said shield means during pre- and post- contacting operations.

5. In combination, a shielded nuclide generator for on-site radioactive parent-to-daughter nuclide generation in which a parent radionuclide absorbed on an ion-exchange bed is selectively contacted with an eluting reagent to generate said short-lived daughter nuclide, comprising:

i. a nuclide generator, including:

a. cylindrical column means having a side wall provided with openings and including means positioned interior of said column means suitable for supporting said ion-exchange bed, and b. bottle means formed with an entryway terminating in a central cavity defined by a side wall and a bottom wall in which said cylindrical column means is located c. said central cavity of said bottle means being larger than said cylindrical column means whereby an annular space is defined therebetween, said annular space being in fluid contact with the interior of said column means through said openings in said side wall thereof, whereby said eluting reagent when placed in said annular space can be conveyed through said openings and thence to the interior of said column means in a batch flow pattern during at least the initialization of the generation process, and ii. a housing shield formed of radiation-resistant material and including an entryway terminating in a central repository defined by a side wall and a bottom wall in which said nuclide generator is located.

6. The shielded nuclide generator of claim 5 in which said bottle means is further characterized by radially protruding lug means adapted to snugly fit within similarly shaped concavities formed in said side wall of said housing shield.

7. A method of generating a radioactive parent-to-daughter nuclide within a nuclide generator centrally positioned in and surrounded by a cylindrical housing shield, said nuclide generator also having a parent isotope absorbed on an ion-exchange bed positioned interior of a cylindrical column, comprising the steps:

i. introducing an eluting agent into a space defined between the exterior of said column means and the interior of said housing shield, said eluting reagent being introduced through an entryway of said housing shield via transfer pipette means having a handle segment always exterior of said housing shield, ii. causing said eluting reagent to flow in a patterned flow from the exterior to the interior of said column means and thence into contact with said parent isotope absorbed on said ion-exchange bed, to thereby generate said daughter nuclide in a region adjacent to said column means near the entryway of said housing shield.

8. The method of claim 7 with the additional steps of adding an incremental amount of eluting reagent into the space between said housing shield and said column means, and removing from said region adjacent the column means said daughter nuclide via transfer pipette means having a handle segment always positioned exterior of said housing shield.

9. The method of claim 8 wherein the daughter nuclide has a specific activity of about 2 mCi/ml.

10. The method of claim 9 wherein the daughter nuclide is $^{137}$mBa.

11. The method of claim 8 wherein the same pipette means is used to add an incremental amount of eluting reagent as well as to remove the daughter nuclide from the region within the column means of the nuclide generator.

* * * * *